United States Patent [19]

Althaus et al.

[11] Patent Number: 4,973,228

[45] Date of Patent: Nov. 27, 1990

[54] ROTOR OF A COMPRESSION-WAVE ENGINE

[75] Inventors: Rolf Althaus, Mägenwil; Jakob Keller, Dottikon, both of Switzerland

[73] Assignee: Asea Brown Boveri Limited, Baden, Switzerland

[21] Appl. No.: 483,104

[22] Filed: Feb. 22, 1990

[30] Foreign Application Priority Data

Mar. 1, 1989 [CH] Switzerland ..... 760/89

[51] Int. Cl.[5] ..... F04F 7/00

[52] U.S. Cl. ..... 417/64

[58] Field of Search ..... 417/64; 123/559.2; 60/39.45

[56] References Cited

U.S. PATENT DOCUMENTS 3,556,680 1/1971 Leutwyler et al. ..... 417/64

FOREIGN PATENT DOCUMENTS 1065909 5/1954 France .

1126705 9/1968 United Kingdom .

*Primary Examiner*—Michael Koczo

*Assistant Examiner*—Robert N. Blackmon

*Attorney, Agent, or Firm*—Burns, Doane, Swecker & Mathis

[57] ABSTRACT

The rotor (1) of a compression-wave engine has cells (6) on its periphery which are concavely curved on the two end faces of the rotor (1) inwards towards its center and towards the rotor axis. Consequently, the absolute trajectory of a particle runs from its entry point (7) into a cell (6) up to its exit point (8) therefrom in a virtually rectilinear fashion, whereby in the scavenging process the mixing zone between the two media participating in the compression-wave process, and thus the scavenging losses, are greatly reduced by comparison with straight cells.

2 Claims, 1 Drawing Sheet

ROTOR OF A COMPRESSION-WAVE ENGINE

BACKGROUND OF THE INVENTION

1. Field of the Invention

The present invention concerns a rotor of a compression-wave engine comprising cells arranged uniformly distributed over its periphery and oriented parallel to the rotor axis, which are intended in operation to receive two gaseous media with the aim of compressing the first medium with compression waves of the second.

2. Discussion of Background

When they are used as supercharger for internal combustion engines, in compression-wave engines ambient air is compressed to supercharging air, and when they are used as high-pressure compressor stage of a gas turbine supercharged air is further compressed in order to generate working gas for the high-pressure turbine component. In this connection, the compression of the air takes place in a rotor, whose periphery in present-day designs generally has cells extending axially parallel, in which the air comes directly into contact, without a fixed separating element, with the exhaust gas of the engine or with working gas branched off from the turbine combustion chamber. In order to control the inlets and outlets of air and gas into, or out of, the cells, casings with passages for the supply and/or removal of the two media participating in the compression-wave process are located on the two end faces of the rotor. When a cell filled with air to be compressed comes before a high-pressure gas inlet, a compression wave runs into the cell and compresses the air. The compression wave reaches the end of the cell as soon as the latter passes the high-pressure air outlet. The air is expelled there, and the cell is then completely filled with gas. Upon further rotation, expansion waves ensure that the gas once again leaves the cell and that fresh air is sucked in, whereupon the compression process is repeated.

A critical circumstance, which contributes decidedly towards the delivery efficiency of a compression-wave blower, consists in that the surface of discontinuity between the two media of air and gas is by no means perpendicular to the axis of the passage, but that a more or less wide mixing zone is formed there, whereby during the scavenging of the compressed air, gas passes into the engine or into the turbine circulation, on the one hand, and a part of the air passes over into the gas, on the other hand.

What has been said above also happens due to the known fact that when two media of different density which have firstly been separated from one another by a diaphragm are located in a passage, upon removal of this diaphragm a balancing flow is set in train, under the influence of gravity in the case of media at rest, apart from the complete mixing of the two gaseous media, as occurs in the state of rest.

In the case of a compression-wave engine, when the rotor is running the heavier medium, that is to say air, is thrust out of the engine under the lighter exhaust gas by the centrifugal acceleration at the outside of the cell, resulting in a mixing zone which is very wide by comparison with the state of rest and, as mentioned above, worsens the scavenging and, consequently, the delivery efficiency of the blower.

SUMMARY OF THE INVENTION

The invention arose from the object of configuring the geometry of the rotor of a compression-wave engine operated with media of different density, especially the form of its cells, in such a way that in the supercharging cycle no centrifugal forces act on the fluid in the cell and, consequently, centrifugal flows, which cause the harmful mixing of the fluids mentioned at the beginning, are avoided. This is achieved by such a configuration of the cells that, from their entry into the cells up to their exit from the same, the particles of a medium move on virtually rectilinear absolute trajectories, that is to say on trajectories which are seen as straight trajectories by an observer conceived as at rest outside the rotor. In this way, the particles are removed from the influence of the accelerating forces. This object is achieved by means of a form of the axes of the passages of the cells which is curved towards the rotor axis.

The characteristic compression-wave engine according to the invention is that, between their two exit sections at the rotor end faces, the axes of the passages of the cells extend radially inwards in a curved fashion towards the rotor axis, the form of the axes of the passages of the cells obeying between their two exit sections the function $$r(x)=r_o\cos(\phi/2)/\cos[\phi(\tfrac{1}{2}-x/L)]$$

where $r_o$ signifies the radial spacing of the axes of the passages from the rotor axis, $\phi$ the angle swept out by a cell from the entry point of the first medium at one rotor end up to its exit point at the other rotor end, and L the rotor length, the x-axis coinciding with the rotor axis and having its origin at the end face of the rotor at which the first medium enters

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF PREFERRED EMBODIMENTS

Figure 1:
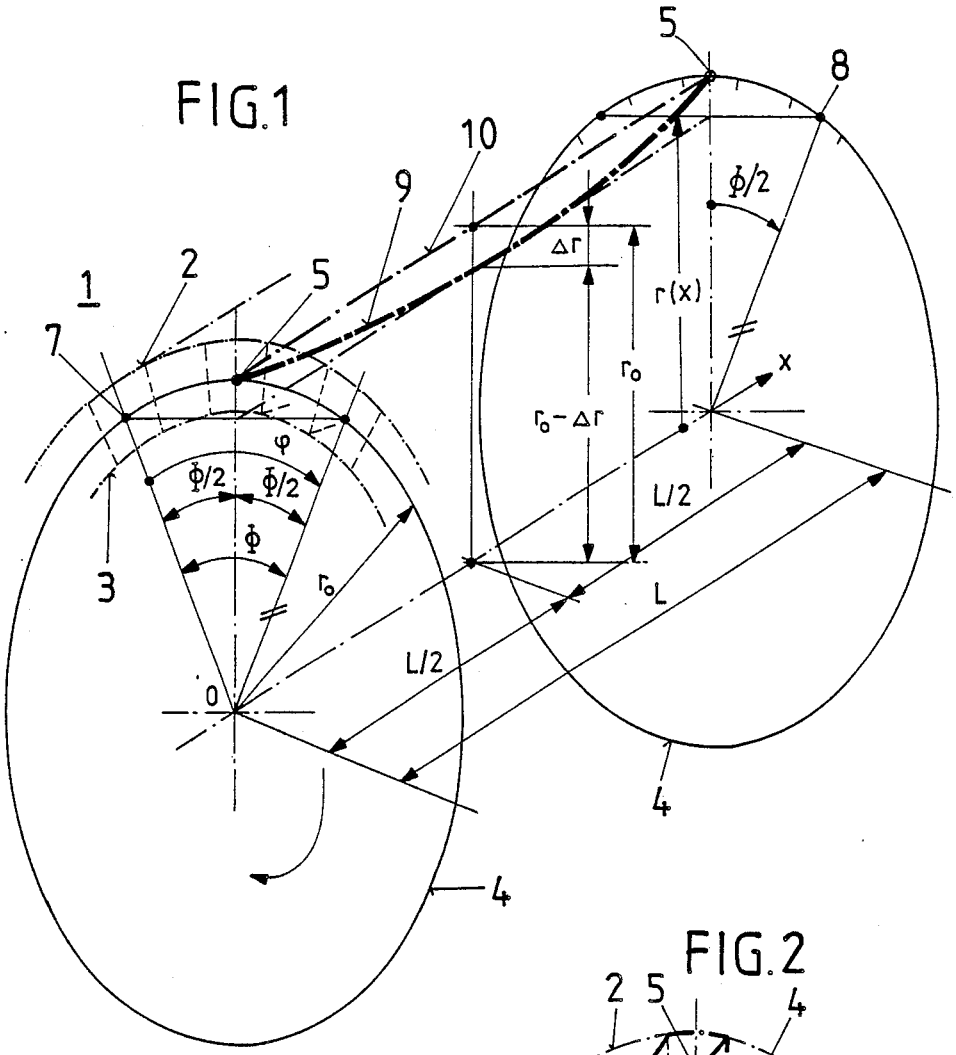
FIG. 1 shows the geometrical relationships which are important for the configuration of a rotor according to the invention.

Referring now to the drawings, wherein like reference numerals designate identical or corresponding parts throughout the several views, in FIG. 1 it is assumed that the direction of rotation of the rotor 1, which is of no importance for its configuration, is clockwise. The following statements hold for a compression-wave engine with a contra-flow compression wave process during which entry and exit of the air take place on the two opposite sides of the rotor, but they also hold in analogous fashion for the process during which entry and exit of the air take place on one and the same side of the rotor. The abovementioned contra-flow process is that predominantly used with high-pressure compressors for gas turbines.

For the sake of greater lucidity, in FIG. 1 the rotor is represented only sectionally and diagrammatically by its outer boundary circles 2 of the cell ring at its two end faces, the inner boundary circles 3 of the cell ring at the two end faces, and the midpoint circles 4 on which the midpoints 5 of the cross-sections of the cell passages in the two rotor end faces lie. "Cell ring" is understood to mean the totality of the cells 6 at the rotor periphery.

Figure 2:
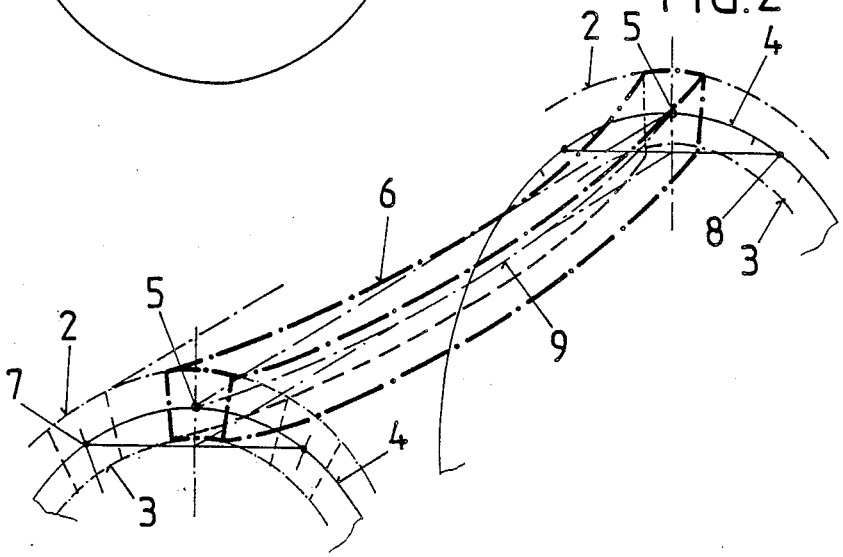
FIG. 2 shows the form of a cell of such a rotor.

The angle $\phi$, which is important above all for the form of the cells 6, is the rotation angle which is swept out by a cell, see FIG. 2, from the point of entry 7, at which the medium to be compressed enters the cell, up to the point of exit 8 on the opposite rotor end face, where the compressed air leaves the cell. Further, in FIG. 1 $\psi$ signifies the running angular coordinate calculated from the point 7, $r_o$ the radius of the midpoint circles 4, O the midpoint of the rotor end face, which coincides with the origin of the x-axis, r(x) the radial distance of a point on the axis of the passage 9 at the spacing x from the origin O, $\Delta r$ the sag of the axis of the passage 9 at a point x by comparison with a straight line 10 connecting the midpoints 5 of the cross-sections of the passages at the two rotor end faces, and L the length of the rotor. With these quantities, the form of the axis of the passage is given by the relationship $$r(x)=r_o\cos(\phi 2)/\cos[\phi(\tfrac{1}{2}-x/L)]$$ and the amount of the sag by $\Delta r=r_o[1-\cos(\phi/2]$.

These two expressions yield approximate values for the form of the axis of the passage and for $\Delta r$, which, both in terms of dimension and also of effect, virtually do not differ from corresponding values which are obtained from exact formulae determined computationally. In each case, the differences occur only in the region of the measurement accuracy.

The necking around $\Delta r$ in the center of the rotor depends essentially upon the entry or exit point of the frontier of discontinuity between the hot gas and the compressed air, the compression ratio and the number of machine ducts. Here, "duct" is to be understood as the totality of inlet and outlet passages of the two cooperating media which are required for a complete compression wave cycle. Most engines, especially compression-wave blowers for engine supercharging, are two-duct, that is to say two compression-wave cycles are run in one rotor revolution. In the case of such an engine with a compression ratio of two, $\phi$, e.g., amounts to 51°.

Thus, with the cell geometry given by r(x), a particle in the cells is impressed with a virtually rectilinear trajectory with the result, required by the object of the invention, that the mixing zone between the two media is maintained as short and as free from mixing as possible. In this system, Coriolis- forces are smaller by an order of magnitude than the centrifugal forces, and could, if required, be corrected by an asymmetric bending of the cell in the azimuthal direction, which is not sensible here for production engineering reasons.

The influence of the centrifugal flows on the scavenging cycle is likewise partially reduced by the form of the cells according to the invention. This influence of the centrifugal flow on the scavenging can be further diminished by further intensifying the necking of the rotor beyond the measure given by the formula for r(x). However, this is not sensible either, since the supercharging cycle is hereby overcompensated and thus somewhat worsened.

In the case of a cross-sectional area of the passages which is constant over the entire cell length, the radial cell walls could be constructed from the center of the rotor to be increasingly thicker in both directions, and their ends thereby profiled in a correctly streamlined fashion. However, it has emerged that this is sensible only for the entry side, whereas on the exit side the vortex region is enlarged, and the efficiency is impaired in comparison with a design having sharp-edged ends of the cell walls on both sides.

Obviously, numerous modifications and variations of the present invention are possible in the light of the above teachings. It is therefore to be understood that within the scope of the appended claims, the invention may be practised otherwise than as specifically described herein.

What is claimed as new and desired to be secured by patent of the United States is:

1. A rotor of a compression-wave engine, comprising cells (6) arranged uniformly distributed over its periphery and oriented parallel to the rotor axis( which are intended in operation to receive two gaseous media with the aim of compressing the first medium with compression waves of the second, each cell having two exit sections and wherein between said two exit sections at the rotor end faces the axes (9) of the passages of the cells (6) extend radially inwards in a curved fashion towards the rotor axis (x), the form of the axes (9) of the passages of the cells (6) obeying between their two exit sections the function $$r(x)=r_o\cos(\phi/2)/\cos[\phi(\tfrac{1}{2}-x/L)]$$

where $r_o$ signifies the radial spacing of the axes (9) of the passages from the rotor axis (x), the angle swept out by a cell from the entry point (7) of the first medium at one rotor end up to its exit point (8) at the other rotor end, and L the rotor length, the x-axis coinciding with the rotor axis and having its origin (O) at the end face of the rotor (1) at which the first medium enters.

2. A rotor as claimed in claim 1, wherein the cells (6) have the same passage cross-section over their entire length, the wall thicknesses of the cell walls increase towards the entry side of the first medium, starting from the point of the axis (9) of the passage that is closest to the rotor axis (x), and the cell walls are profiled at this entry side in a correctly streamlined fashion.

* * * * *